US012546525B2

(12) United States Patent
Winckler et al.

(10) Patent No.: US 12,546,525 B2
(45) Date of Patent: Feb. 10, 2026

(54) DISPENSER ASSEMBLY FOR STAND-ALONE ICE MAKING APPLIANCE

(71) Applicant: Haier US Appliance Solutions, Inc., Wilmington, DE (US)

(72) Inventors: Rachel Winckler, Louisville, KY (US); Lauren Nicole Platts, Louisville, KY (US); Minjoo Han, Louisville, KY (US); Mason Hawkins, Louisville, KY (US); Alexander Marovec, South Haven, MI (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 73 days.

(21) Appl. No.: 18/419,151

(22) Filed: Jan. 22, 2024

(65) Prior Publication Data

US 2025/0237424 A1 Jul. 24, 2025

(51) Int. Cl.
*F25C 5/20* (2018.01)
*F25C 5/182* (2018.01)

(52) U.S. Cl.
CPC ..... *F25C 5/24* (2018.01); *F25C 5/182* (2013.01); *F25C 2400/04* (2013.01)

(58) Field of Classification Search
CPC ..... F25C 5/24; F25C 2400/14; F25C 5/182
See application file for complete search history.

(56) References Cited

U.S. PATENT DOCUMENTS

| | | | | |
|---|---|---|---|---|
| 3,216,213 | A | 11/1965 | Eschenburg et al. | |
| 3,687,339 | A | 8/1972 | Dessureault | |
| 3,796,063 | A * | 3/1974 | Wulke | F25C 1/04 62/340 |
| 3,908,395 | A | 9/1975 | Hobbes | |
| 4,997,109 | A | 3/1991 | Carper | |
| 6,758,047 | B1 | 7/2004 | Giles | |
| 2010/0281908 | A1 | 11/2010 | Kim | |
| 2018/0073792 | A1 * | 3/2018 | Tarr | C02F 1/325 |
| 2022/0049889 | A1 | 2/2022 | Katzman | |

FOREIGN PATENT DOCUMENTS

| | | | | |
|---|---|---|---|---|
| CN | 113932507 | B | 4/2022 | |
| EP | 2494286 | B1 * | 8/2018 | F25C 5/185 |
| GB | 598271 | A | 2/1948 | |
| GB | 2394764 | A | 5/2004 | |
| KR | 101647050 | B1 | 8/2016 | |
| KR | 20220157771 | A | 11/2022 | |

OTHER PUBLICATIONS

EP-2494286-B1 translation.*
Home Centre, Palestine acrylic rice dispenser—15L, https://www.homecentre.in/in/en/Home-Centre/Kitchen/Storage-And-Containers/Containers-%26-Jars/HOMECENTRE-Palestine-Acrylic-Rice-Dispenser--15L/p/1000009899522, accessed Jan. 22, 2024, 3 pages.

* cited by examiner

*Primary Examiner* — Elizabeth J Martin
(74) *Attorney, Agent, or Firm* — Dority & Manning, P.A.

(57) ABSTRACT

An ice making appliance includes a casing, a user interface on the casing, a container within the casing, and a dispenser assembly coupled to a front surface of the container. The dispenser assembly includes a front portion configured to operate the dispenser assembly. The dispenser assembly is configured to dispense a specified amount of ice, and operated, the dispenser assembly, excluding the front portion, remains either completely inside of the container or completely outside of the container.

12 Claims, 19 Drawing Sheets

DISPENSER ASSEMBLY FOR STAND-ALONE ICE MAKING APPLIANCE

FIELD OF THE INVENTION

The present subject matter relates generally to ice making appliances, and more particularly to dispenser assemblies of ice making appliances.

BACKGROUND OF THE INVENTION

Stand-alone ice making appliances are separate appliances from refrigerator appliances and provide independent ice supplies. Generally, liquid water is added to the stand-alone ice makers, and the ice maker operates to freeze the liquid water and form ice. Ice making appliances have many components that are regular points of contact for users, such as within the ice container when acquiring ice. Typical contact points can pass germs or accumulate bacterial growth over time. As such, the contact points can transfer germs to the ice produced by the ice making appliance.

Accordingly, improved stand-alone ice making appliances are desired in the art. In particular, stand-alone ice making appliances that address preventing or minimizing the transfer of germs to the ice within the appliance would be advantageous.

BRIEF DESCRIPTION OF THE INVENTION

Aspects and advantages of the invention will be set forth in part in the following description, or may be obvious from the description, or may be learned through practice of the invention.

In one example embodiment, a stand-alone ice making appliance includes a casing, a user interface on the casing, a container within the casing, a reservoir disposed within the casing, an ice maker disposed within the casing, and a dispenser assembly coupled to a front surface of the container. The dispenser assembly includes a front portion configured to operate the dispenser assembly. The dispenser assembly is configured to dispense a specified amount of ice, and operated, the dispenser assembly, excluding the front portion, remains either completely inside of the container or completely outside of the container.

In another example embodiment, an ice making appliance includes a casing, a user interface on the casing, a container within the casing, and a dispenser assembly coupled to a front surface of the container. The dispenser assembly includes a front portion configured to operate the dispenser assembly. The dispenser assembly is configured to dispense a specified amount of ice, and operated, the dispenser assembly, excluding the front portion, remains either completely inside of the container or completely outside of the container.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
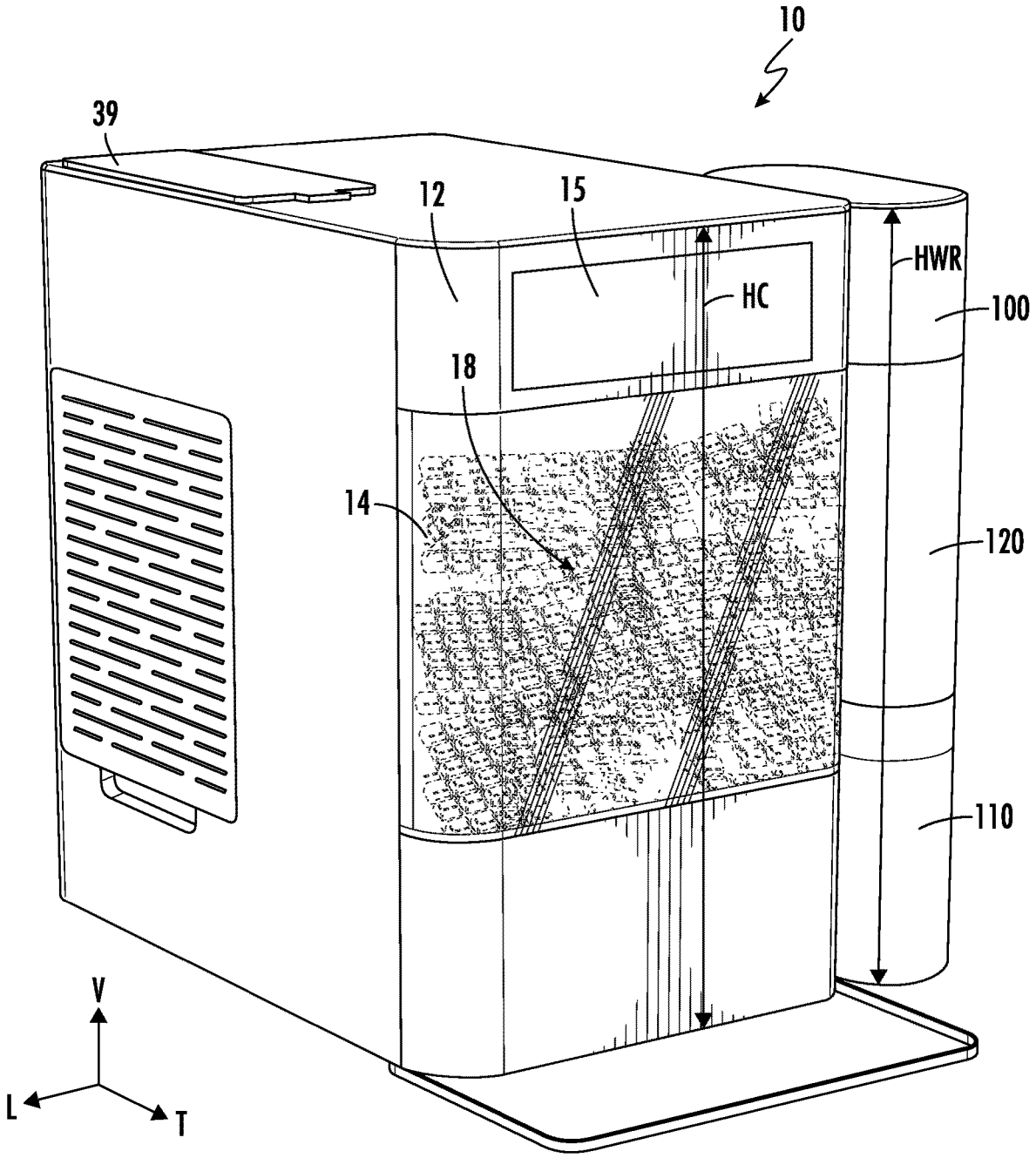
FIG. 1 is a perspective view of an appliance according to an example embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
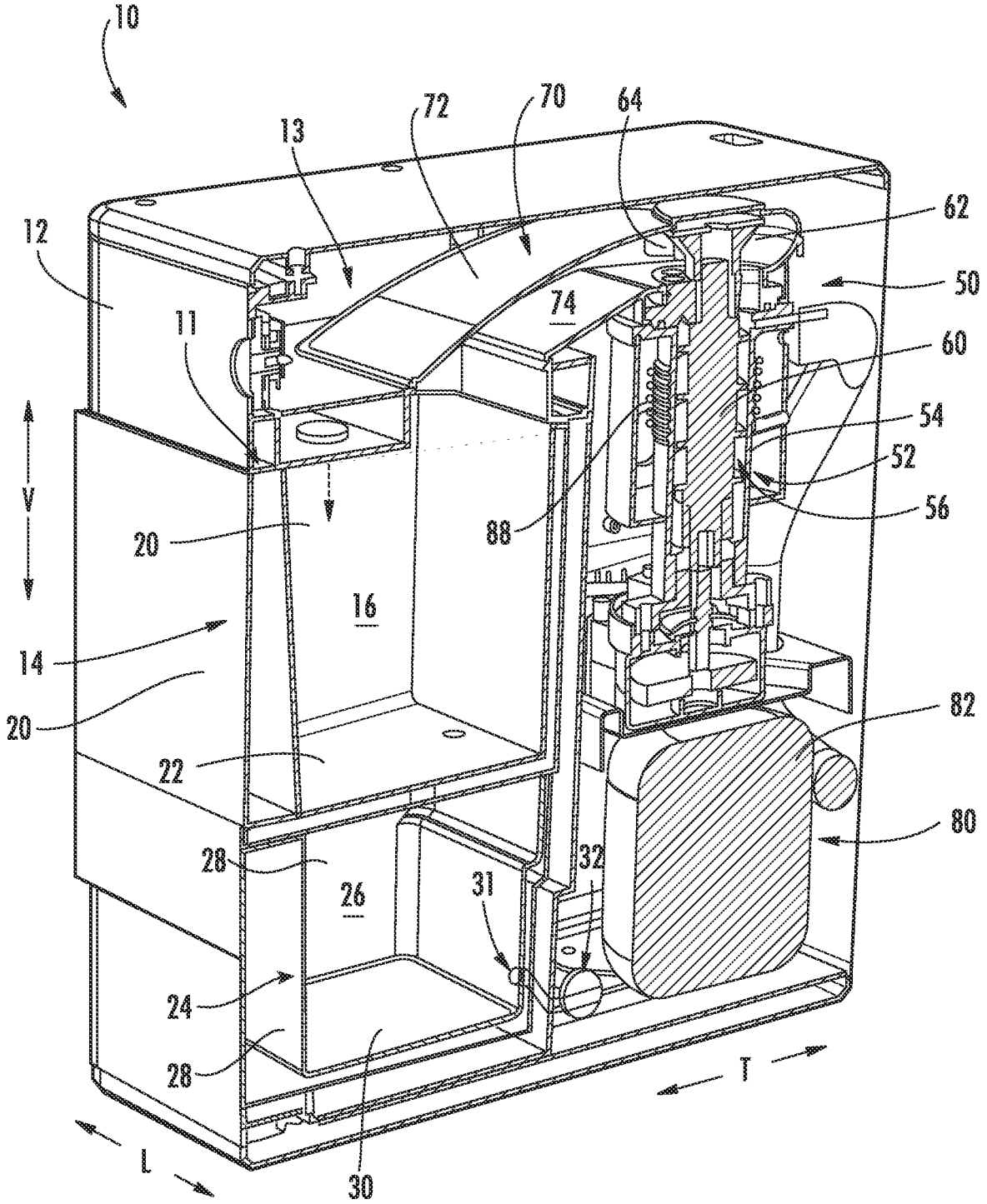
FIG. 2 is a perspective section view of the example appliance of FIG. 1.
Figure 3:
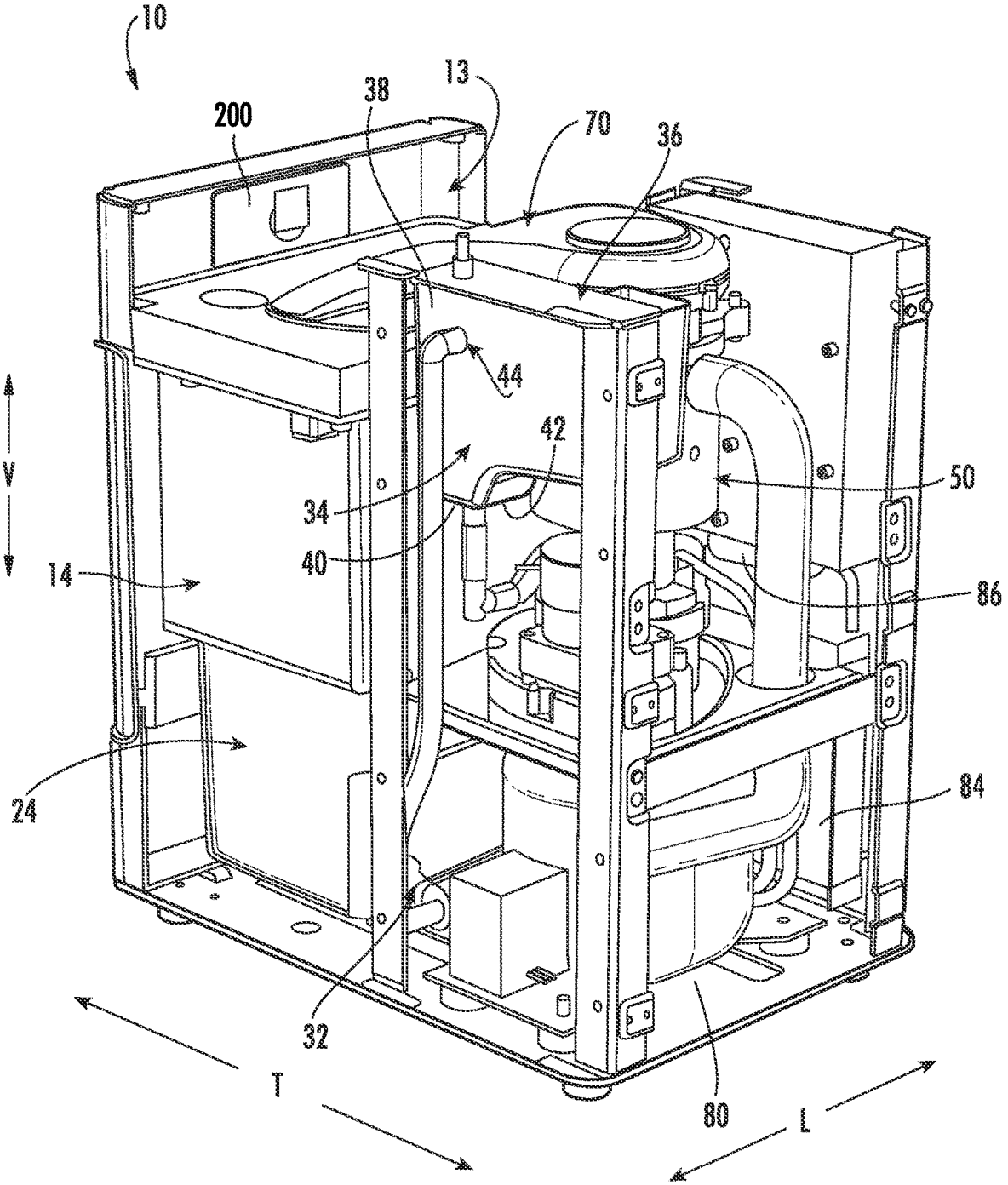
FIG. 3 is a rear perspective view of the example appliance of FIG. 1 with a casing of the example appliance removed to show interior components of the example appliance.

Referring now to FIGS. 1 through 3, one embodiment of an appliance 10 in accordance with the present disclosure is illustrated. As shown, appliance 10 is provided as a stand-alone ice making appliance embodiment. Appliance 10 includes an outer casing 12 which defines a primary opening 11 (e.g., first primary opening) and an internal cavity or volume 13. Internal volume 13 generally at least partially houses various other components of the appliance therein 10. Primary opening 11 defined in outer casing 12 may extend internal volume 13 to an ambient environment. Through primary opening 11, access (e.g., by a user) to the internal volume 13 may be permitted. Outer casing 12 further defines a vertical direction V, a lateral direction L, and a transverse direction T. The vertical direction V, lateral direction L, and transverse direction T are mutually perpendicular and form an orthogonal direction system.

A container 14 of appliance 10 is also illustrated. Container 14 defines a first storage volume 16 for the receipt and storage of ice 18 therein. A user of the appliance 10 may access ice 18 within the container 14 for consumption or other uses, as described in detail below. Container 14 may include multiple walls, including one or more sidewalls 20 and a base wall 22, which may together define the first storage volume 16. In example embodiments, at least one sidewall 20, e.g., a front surface 21 of the container 14, may be formed in part from a clear, see-through (i.e., transparent, or translucent) material, such as a clear glass or plastic, such that a user can see into the first storage volume 16 and thus view ice 18 therein. For instance, at least one sidewall 20 may include a separate external panel and internal panel formed from a clear, see-through (i.e., transparent, or translucent) material, such as a clear glass or plastic. In general, a user interface 15 may be positioned on casing 12 above container 14. User interface 15 may generally include input selectors to be selected (e.g., by a user) for controlling the appliance 10.

Appliances 10 in accordance with the present disclosure are advantageously stand-alone appliances, and thus are not connected to refrigerators or other appliances. Additionally, in example embodiments, such appliances are not connected to plumbing or another water source that is external to the appliance 10, such as a refrigerator water source. Rather, in example embodiments, water is initially supplied to the appliance 10 manually by a user, such as by pouring water into water tank 24 and/or an auxiliary reservoir 100. Optionally, in example embodiments, water tank 24 may be removable, such as from the outer casing 12, by a user. This facilitates advantageous easy access by the user to water tank 24 (e.g., in order to easily fill water tank 24), as discussed below.

Notably, appliances 10 as discussed herein include various features which allow the appliances 10 to be affordable and desirable to typical consumers. For example, the stand-alone feature reduces the cost associated with the appliance 10 and allows the consumer to position the appliance 10 at any suitable desired location, with the only requirement in some embodiments being access to an electrical source.

As discussed herein, appliance 10 is configured to make nugget ice, which is becoming increasingly popular with consumers. Ice 18 may be nugget ice. Generally, nugget ice is ice that that is maintained or stored (i.e., in first storage volume 16 of container 14) at a temperature greater than the melting point of water or greater than about thirty-two degrees Fahrenheit. Accordingly, the ambient temperature of the environment surrounding the container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit.

Still referring to FIGS. 1 through 3, various components of appliance 10 in accordance with the present disclosure are illustrated. For example, as mentioned, appliance 10 includes a water tank 24. The water tank 24 defines a second storage volume 26 for the receipt and holding of water. Water tank 24 may include multiple walls, including one or more sidewalls 28 and a base wall 30, which may together define the second storage volume 26. In example embodiments, the water tank 24 may be disposed below the container 14 along the vertical direction V defined for the appliance 10, as shown.

As discussed, in example embodiments, water is provided to the water tank 24 for use in forming ice. Accordingly, appliance 10 may further include a pump 32. Pump 32 may be in fluid communication with the second storage volume 26. For example, water may be flowable from the second storage volume 26 through a fluid outlet 31 defined in the water tank 24, such as in a sidewall 28 thereof, and may flow through a conduit to and through pump 32. Pump 32 may, when activated, be operable to actively flow water from the second storage volume 26 therethrough and from the pump 32.

Figure 5:
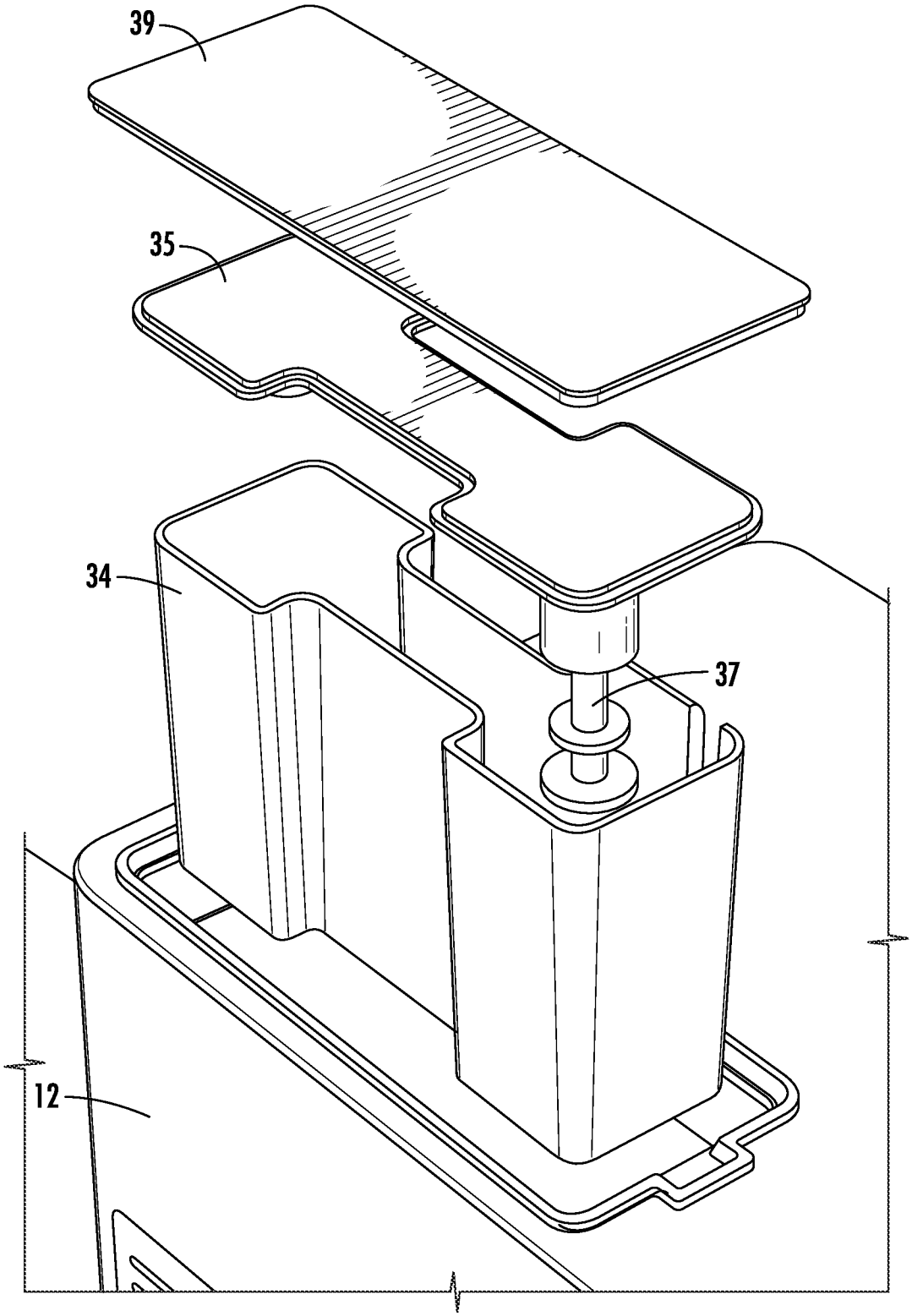
FIG. 5 is an exploded perspective view of a portion of the example appliance of FIG. 1.

Water actively flowed from the pump 32 may be flowed (e.g., through a suitable conduit) to a reservoir 34. For example, reservoir 34 may define a third storage volume 36. In some embodiments, third storage volume 36 is defined by one or more sidewalls 38 and a base wall 40. Third storage volume 36 may, for example, be in fluid communication with the pump 32 and may thus receive water that is actively flowed from the water tank 24, such as through the pump 32. During operation, water may be flowed into the third storage volume 36 through an opening 44 defined in the reservoir 34. Referring briefly to FIG. 5, provided is an exploded perspective view of reservoir 34. Reservoir 34 may generally include a cover 39 encasing reservoir 34 within casing 12. In some example embodiments, reservoir may include an internal lid 35 to seal the reservoir 34 within casing 12. Internal lid 35 may include a float sensor 37 for monitoring the water level inside of reservoir 34.

Referring again to FIGS. 1 through 3, reservoir 34 and third storage volume 36 thereof may receive and contain water to be provided to an ice maker 50 for the production of ice. Accordingly, third storage volume 36 may be in fluid communication with ice maker 50. For example, water may be flowed, such as through an opening 42 and through suitable conduits, from third storage volume 36 to ice maker 50.

Ice maker 50 generally receives water, such as from reservoir 34, and freezes the water to form ice 18. In example embodiments, ice maker 50 is a nugget ice maker, and in particular is an auger-style ice maker, although other suitable styles of ice makers and/or appliances are within the scope and spirit of the present disclosure. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening may be defined in a sidewall 54. Water may be flowed from third storage volume 36 through the opening (such as via a suitable conduit) into the interior volume 56.

As illustrated, an auger 60 may be disposed at least partially within casing 52. During operation, the auger 60 may rotate. Water within casing 52 may at least partially freeze due to heat exchange, such as with a refrigeration system as discussed herein. The at least partially frozen water may be lifted by the auger 60 from casing 52. Further, in example embodiments, the at least partially frozen water may be directed by auger 60 to and through an extruder 62. Extruder 62 may extrude the at least partially frozen water to form ice, such as nuggets of ice 18, or other pieces of ice, such as ice cubes or any other suitable ice pieces.

Formed ice 18 may be provided by the ice maker 50 to container 14 and may be received in the first storage volume 16 thereof. For example, ice 18 formed by auger 60 and/or extruder 62 may be provided to container 14. In example embodiments, appliance 10 may include a chute 70 for directing ice 18 produced by the ice maker 50 towards the first storage volume 16. For example, as shown, chute 70 is generally positioned above container 14 along the vertical direction V. Thus, ice can slide off of chute 70 and drop into storage volume 16 of container 14. Chute 70 may, as shown, extend between ice maker 50 and container 14, and may include a body 72, which defines a passage 74 therethrough. Ice 18 may be directed from the ice maker 50 (such as from the auger 60 and/or extruder 62) through passage 74 to the container 14. In some embodiments, for example, a sweep 64, which may be connected to and rotate with the auger, may contact the ice emerging through the extruder 62 from the auger 60 and direct the ice 18 through the passage 74 to the container 14.

As discussed, water within casing 52 may at least partially freeze due to heat exchange, such as with a refrigeration system. In example embodiments, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86, and an evaporator 88. Evaporator 88 may, for example, be in thermal communication with the casing 52 in order to remove heat from the interior volume 56 and water therein during operation of sealed system 80. For example, evaporator 88 may at least partially surround casing 52. In particular, evaporator 88 may be a conduit coiled around and in contact with casing 52, such as the sidewall(s) 54 thereof.

It should additionally be noted that, in example embodiments, a controller 200 may be in operative communication with the sealed system 80, such as with the compressor 82 thereof, and may activate the sealed system 80 as desired or required for ice making purposes.

In example embodiments, controller 200 is in operative communication with the pump 32. Such operative communication may be via a wired or wireless connection and may facilitate the transmittal and/or receipt of signals by the controller 200 and pump 32. Controller 200 may be configured to activate the pump 32 to actively flow water. For example, controller 200 may activate pump 32 to actively flow water therethrough when, for example, reservoir 34 requires water. A suitable sensor(s), for example, may be provided in the third storage volume 36. The sensor(s) may be in operative communication with the controller 200 and may be configured to transmit signals to the controller 200, which may indicate whether or not additional water is desired in the reservoir 34. When controller 200 receives a signal that water is desired, controller 200 may send a signal to pump 32 to activate pump 32.

Figure 4:
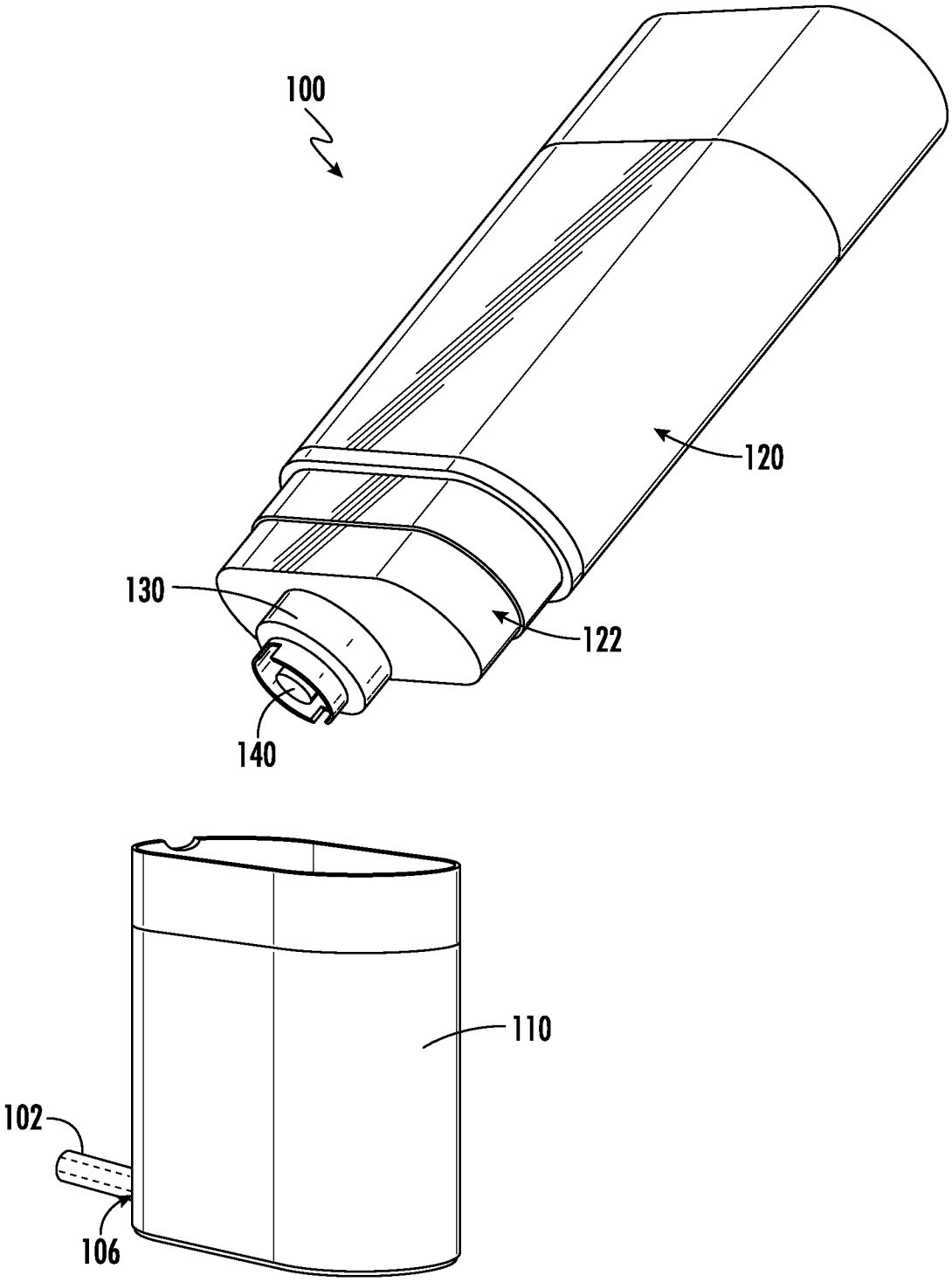
FIG. 4 is a perspective view of the example auxiliary reservoir in FIG. 1.

As shown in FIG. 1, appliance 10 may also include an auxiliary water reservoir 100. FIG. 4 also illustrates auxiliary water reservoir 100 according to another example embodiment. Auxiliary water reservoir 100 is described in greater detail below with reference to FIGS. 1 and 4. As may be seen in FIG. 1, a height HWR of auxiliary water reservoir 100 may be about equal to a height HC of casing 12. Thus, the appearance of auxiliary water reservoir 100 may complement casing 12.

Auxiliary water reservoir 100 may be disposed outside of casing 12. For example, auxiliary water reservoir 100 may be mounted at the side of casing 12. Thus, while most components of appliance 10 are housed within casing 12, auxiliary water reservoir 100 is positioned outside of casing 12. In certain example embodiments, auxiliary water reservoir 100 may include a base 110 and a container 120. Base 110 may be attached to casing 12, e.g., at the side of casing 12 adjacent to the bottom of casing 12. For instance, base 110 may be clipped, fastened, etc. to casing 12. As may be seen in FIG. 4, container 120 is removably mounted to base 110. For example, a cap 130 positioned at a bottom portion 122 of container 120 may be received within base 110 to mount container 120 on base 110. A user may lift upwardly on container 120 to remove container 120 from base 110, and the user may insert cap 130 of container 120 into base 110 to mount container 120 on base 110. As an example, the user may remove container 120 from base 110 in order to conveniently fill container 120 with water at a faucet.

Auxiliary water reservoir 100 may be in fluid communication with a water tank within casing 12 such that water within auxiliary water reservoir 100 is flowable to the water tank. For example, a flexible tubing conduit, or a supply line 102, may extend from auxiliary water reservoir 100 to water tank 24, and water from within auxiliary water reservoir 100 may flow from auxiliary water reservoir 100 into second storage volume 26 via supply line 102. It will be understood that appliance 10 may be plumbed in any other suitable manner to deliver water from auxiliary water reservoir 100 into casing 12 for use with ice maker 50 in alternative example embodiments.

Auxiliary water reservoir 100 may include a check valve 140, such as a normally closed check valve. Check valve 140 may be mounted to container 120, e.g., positioned in cap 130 at bottom portion 122 of container 120. Check valve 140 may be configured such that check valve 140 is open when container 120 is mounted to base 110. In addition, check valve 140 may be configured such that check valve 140 is closed when container 120 is removed from base 110. When check valve 140 is open, check valve 140 may allow water within container 120 to flow into base 110. Within base 110, the water may flow to outlet 106 and thus supply line 102, as described above.

Turning now to FIGS. 6-19, provided are various embodiments of dispensing assemblies for appliance 10, generally configured for dispensing ice 18 from container 14. In general, stand-alone appliance 10 may include a dispenser assembly 210 coupled to and extending within a front surface 21 of container 14. Dispenser assembly 210 may be generally configured to dispense a specified amount of ice 18 from container 14. In particular, the specified amount of ice 18 dispenser assembly 210 may be a fixed amount of ice 18 that is about the same each time ice 18 is dispensed from container 14, e.g., the specified amount of ice 18, e.g., the specified amount of ice may generally be between two (2) and ten (10), such as between four (4) and eight (8), such as between five (5) and six (6) nuggets of ice 18 (or other ice pieces as well as or instead of nuggets). The specified amount of ice 18 dispensed by the various embodiments of dispenser assembly 210 will be further described hereinbelow. Additionally, the dispensing of ice 18 from appliance 10 may generally include dispenser assembly 210 ejecting ice 18 and/or ice 18 falls out via gravity, in order to reduce user interaction within appliance 10, e.g., reduce the need for a user to put hands or scoops or other utensils into appliance 10 to get ice 18.

Figure 6:
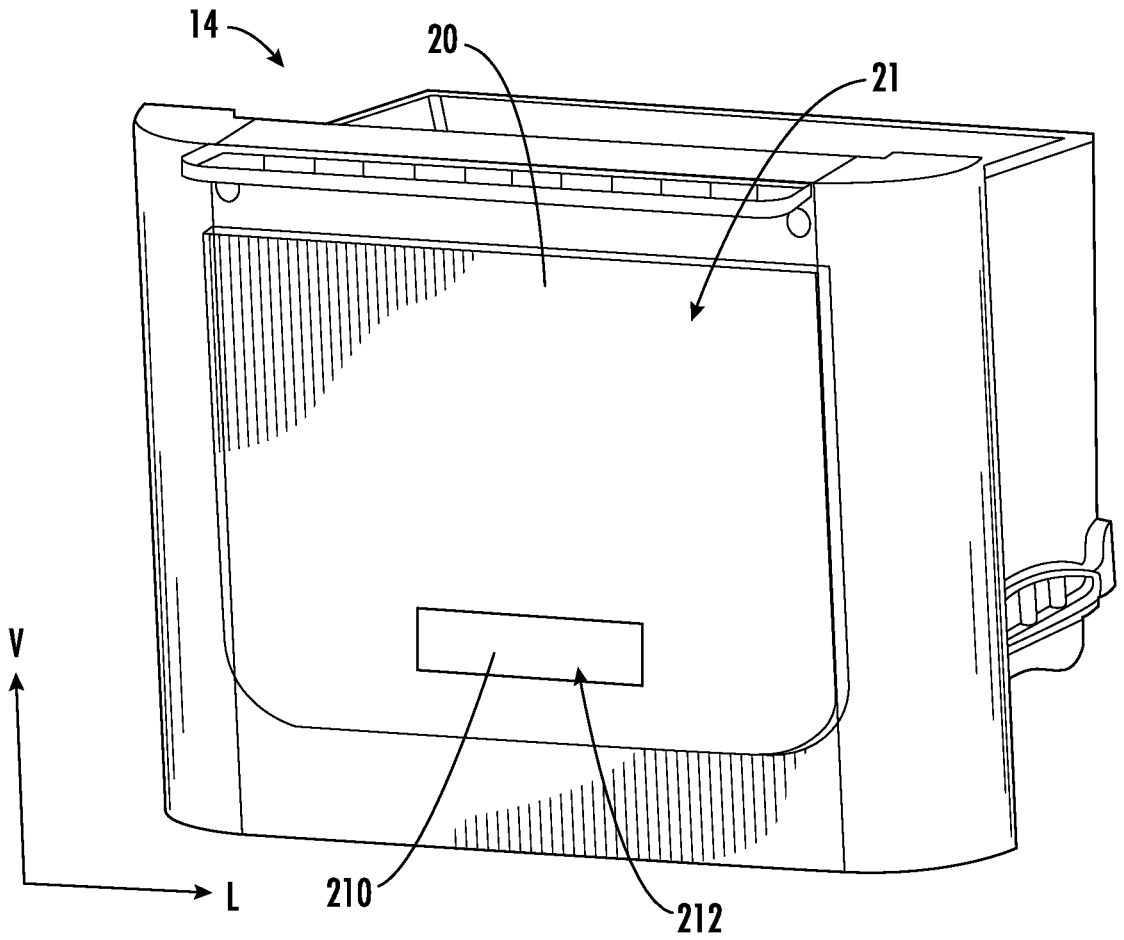
FIG. 6 is a perspective view of an example embodiment a container of the example appliance of FIG. 1.

Illustrated in FIG. 6 is a perspective view of one example embodiment a container 14 of appliance 10. In the present example embodiment, a front portion 212 of a dispenser assembly 210 may include a front surface that is flush with front surface 21 of container 14. In general, dispenser assembly 210 may be moveable between a closed position, e.g., flush with front surface 21 of container 14, and an open position, e.g., at least partially extended outward from container 14. Additionally, dispenser assembly 210 may include a front portion 212 configured to operate the dispenser assembly, e.g., moving dispenser assembly 210 from the closed position to the open position may occur by interacting with the front portion of dispenser assembly 210. Further, dispenser assembly 210 may include a compartment 214, or multiple compartments. The compartment 214, or each compartment in embodiments where multiple compartments are provided, may be generally configured to hold the specified amount of ice 18. For example, when in the closed position, the compartment may receive the specified amount of ice 18 by gravity and hold the specified amount of ice 18 within an internal volume of the appliance 10, e.g., inside the casing 12 and/or container thereof. For example, compartment 214 may hold the specified amount of ice within container 14 and/or in a space that is contiguous with an internal volume of container 14, e.g., first storage volume 16. Moreover, when in the open position, compartment 214 may be accessible from outside of container 14 and the specified amount of ice 18 may be dispensed. The compartment(s) of dispenser assembly 210 will be further described in hereinbelow.

Figure 7:
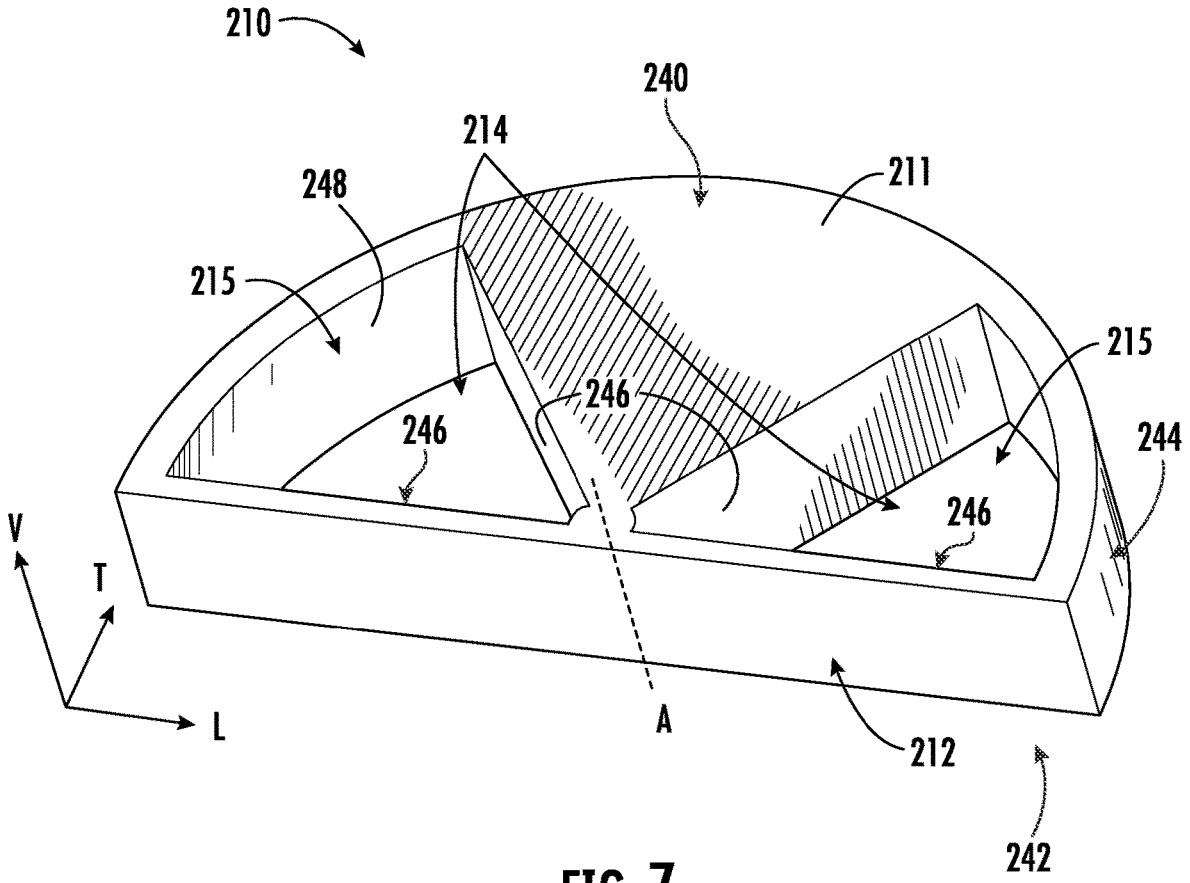
FIG. 7 is a perspective view of one example embodiment of a dispenser assembly at the container of FIG. 6.
Figure 8:
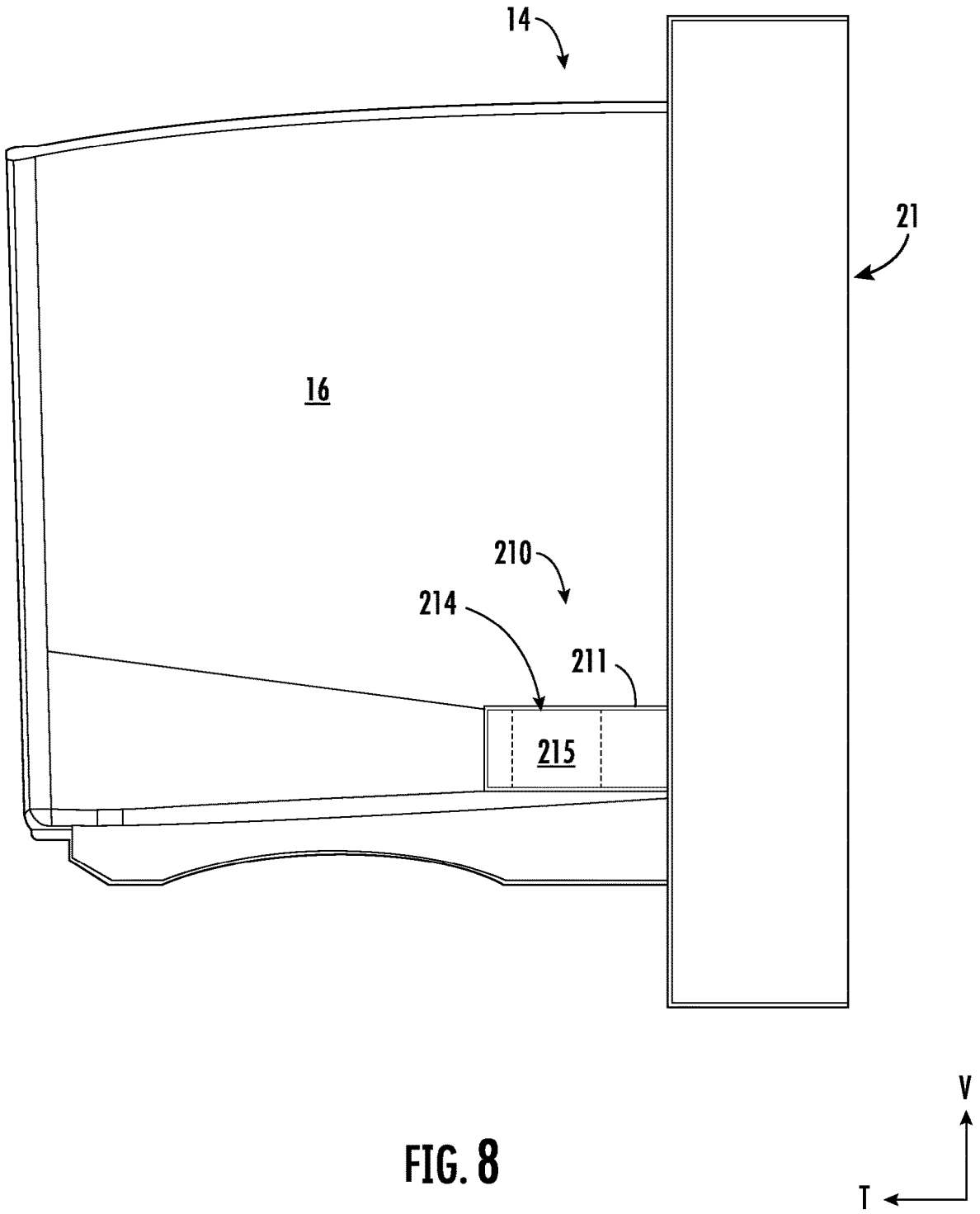
FIG. 8 is a side view of the container of FIG. 6 with the example embodiment of the dispenser assembly of FIG. 7 coupled to and positioned therein.

Illustrated in FIGS. 7-8 are a perspective view and a side view, respectively, of one example embodiment of dispenser assembly 210 coupled to the container of FIG. 6. In the present example embodiment, front portion 212 of dispenser assembly 210 may be a front surface of a rotatable half-puck 211. For example, rotatable half-puck 211 may extend within container 14 from front surface 212. In general, half-puck 211 may extend between a top side 240 and a bottom side 242 in the vertical direction V, and between front portion 212 and outer side/arch 244. Outer arch 244 may have an arc length no less than five centimeters (5 cm), such as between five centimeters (5 cm) and twenty centimeters (20 cm), such as between 10 centimeters (10 cm) and 15 centimeters (15 cm). In general, rotatable half-puck 211 may include a compartment 214, such as one or more openings or cutouts defined through rotatable half-puck 211, e.g., compartments 214 in rotatable half-puck 211 may be defined between a pair of inner walls 246 and an inner arch 248, such that an internal volume 215 of compartment 214 is defined. In particular, rotatable half-puck 211 may be configured to parcel the specified amount of ice 18 in the internal volume 215 of compartment 214 for dispensing. In other words, rotatable half-puck 211 may be configured to transport the specified amount of ice 18 from inside container 14 to outside of container 14, where rotatable half-puck 211 also rotates from inside container 14 to outside of container 14.

In general, internal volume 215 (inner walls 246 and an inner arch 248) may be sized within rotatable half puck 211 to allot for the specified amount of ice 18, e.g., the specified amount of ice may be between two (2) and ten (10), such as between four (4) and eight (8), such as between five (5) and six (6) nuggets of ice 18 held within compartment 214. In general, the front portion 212 is configured to operate the dispenser assembly 210, rotatable half-puck 211, by pushing on the front portion 212 to rotate the half-puck 211 to the open position. In particular, rotatable half-puck 211 may be rotated via applying pressure to front portion 212, thereby rotating rotatable half-puck 211 around axis A, exposing compartment 214 to outside of container 14, whereby the specified amount of ice 18 within compartment 214 may be dispensed.

In other words, a countertop nugget ice maker may include a container with a rotating disk to dispense a specified amount of ice (e.g., 2-10 nuggets). The container may include a slot provided with the rotating disk at the front, which may dispense the specified amount of ice as it rotates. The rotatable half-puck may be flush with the front surface of the container when closed.

Figure 9:
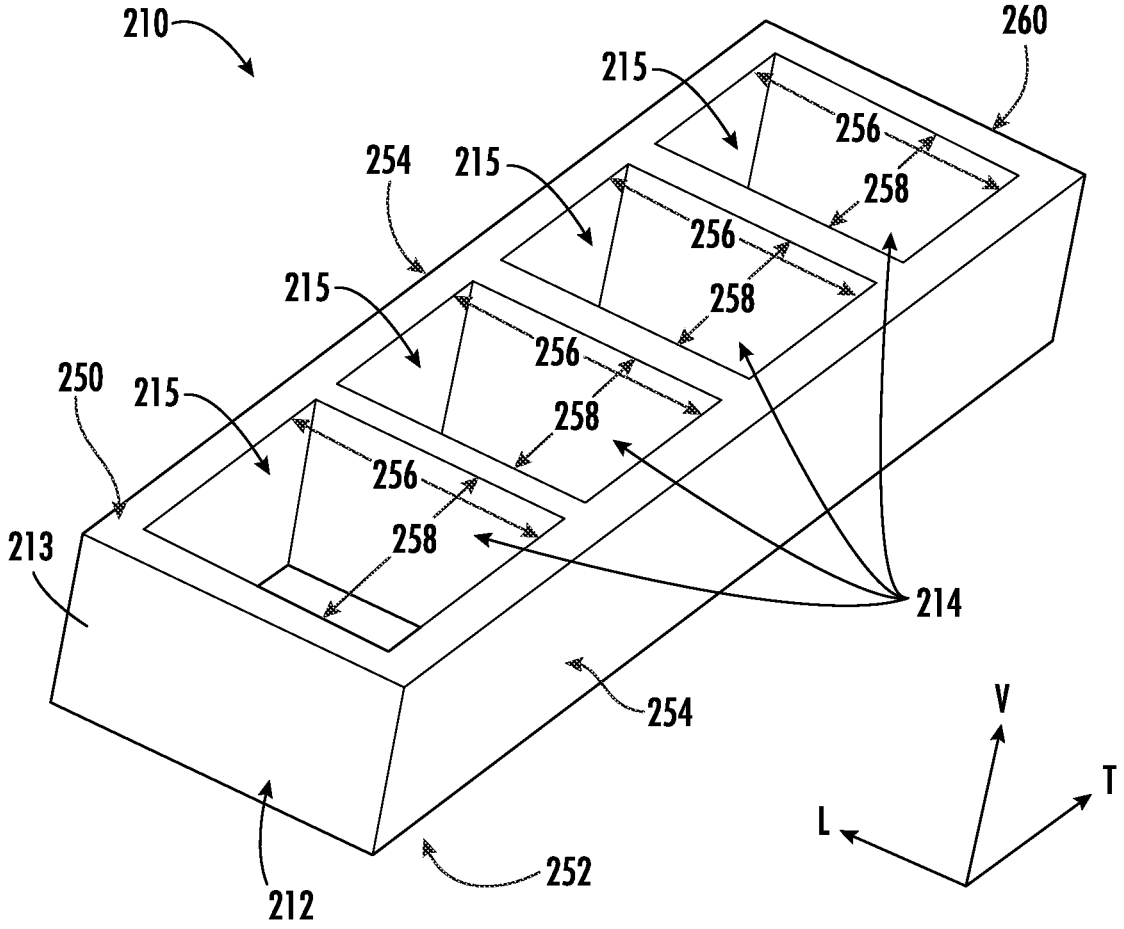
FIG. 9 is a perspective view of another example embodiment of a dispenser assembly of FIG. 6.
Figure 10:
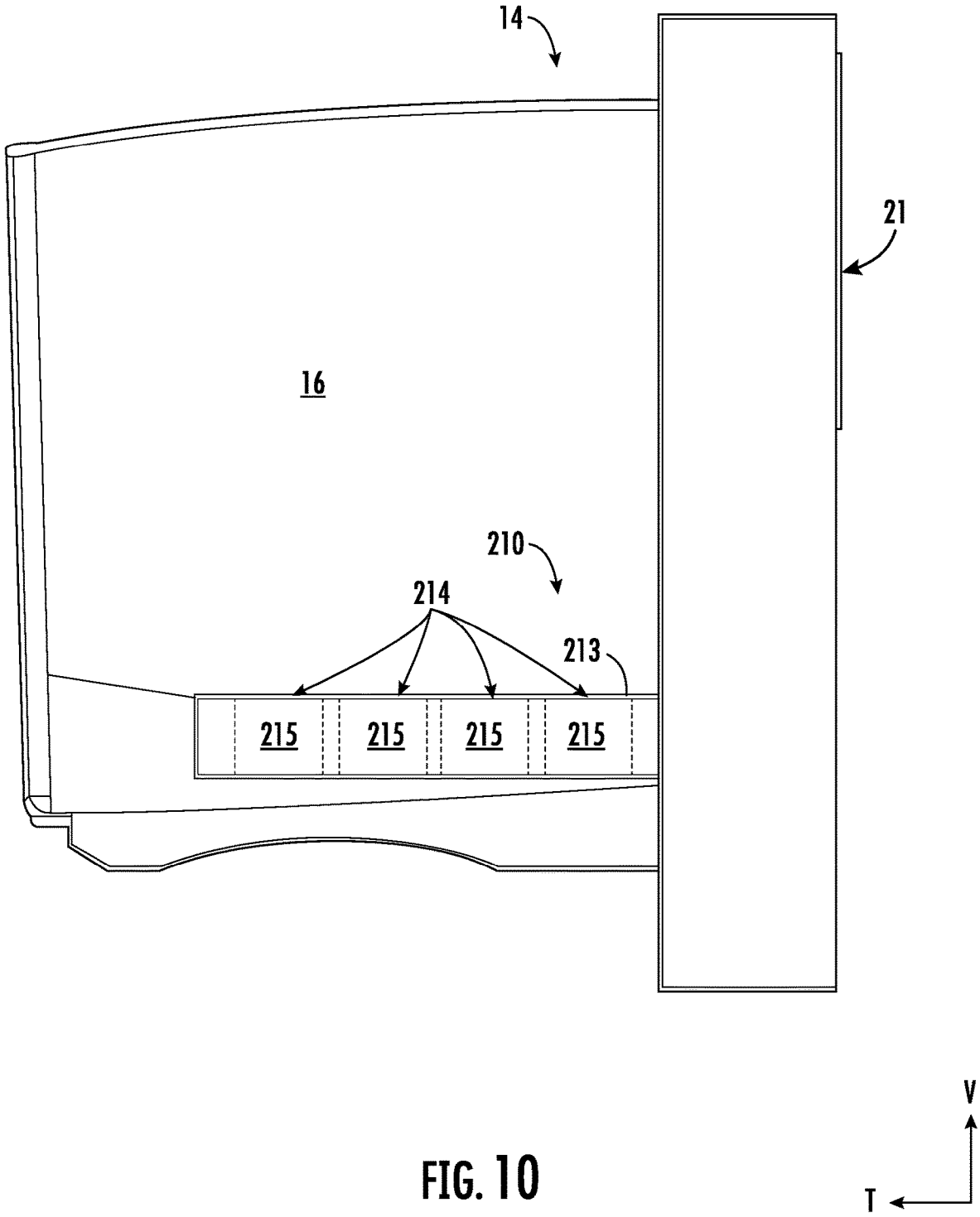
FIG. 10 is a side view of the container of FIG. 6 with the example embodiment of the dispenser assembly of FIG. 9 coupled to and positioned therein.

Illustrated in FIGS. 9-10 are a perspective view and a side view, respectively, of another example embodiment of the dispenser assembly of FIG. 6. In the present example embodiment, front portion 212 of dispenser assembly 210 may be the front surface of a tray 213 slidably mounted to and extending within container 14. Tray 213 may be generally rectangularly shaped, such as the tray 213 may define a rectangular prism shape. For example, tray 213 may generally extend between a top side 250 and a bottom side 252 in the vertical direction V, between a pair of opposing outer sidewalls 254 in the lateral direction L, and between front portion 212 and back side 260 in the transverse direction T. The distance between front portion 212 and back side 260 may be no less than five centimeters (5 cm), such as between five centimeters (5 cm) and twenty centimeters (20 cm), such as between 10 centimeters (10 cm) and 15 centimeters (15 cm) in the transverse direction T. In general, tray 213 of dispenser assembly 210 may include a plurality of compartments 214 defined through tray 213, e.g., each compartment 214 of the plurality of compartments 214 may be generally square or rectangular shaped within tray 213, such as each compartment 214 may be generally cubic or other rectangular prism shape. For example, each compartment 214 of the plurality of compartments 214 in tray 213 may be defined between a pair of opposing inner walls 256 in the lateral direction L and between a pair of opposing inner walls 258 in the transverse direction T, such that an internal volume 215 of each compartment 214 is defined.

As may be seen in FIG. 10, generally, ice 18 within container 14 may fall vertically, e.g., via gravity, into tray 213, such that the specified amount of ice 18 may be parceled into each respective compartment 214 of the plurality of compartments 214 for dispensing. In other words, tray 213 may be configured to transport the specified amount of ice 18 from inside container 14 to outside of container 14, when tray 213 translates from inside container 14 to outside of container 14. For example, each compartment 214 of the plurality of compartments 214 of tray 213 may be sized (between the pair of opposing inner walls 256 in the lateral direction L and between the pair of opposing inner walls 258 in the transverse direction T) such that internal volume 215 of each compartment 214 allots for the specified amount of ice 18, e.g., the specified amount of ice may be between two (2) and ten (10), such as between four (4) and eight (8), such as between five (5) and six (6) nuggets of ice 18 held within compartment 214. In general, the front portion 212 is configured to operate the dispenser assembly 210, tray 213, by pushing on the front portion 212 to eject the tray 213 to the open position. In particular, tray 213 may be moved to the open position via applying pressure to front portion 212, thereby engaging a 'push to open' mechanism, such mechanism would be understood by those skilled in the art, exposing one or more of the plurality of compartments 214 to outside of container 14, whereby the specified amount of ice 18 within compartment(s) 214 may be dispensed.

Figure 11:
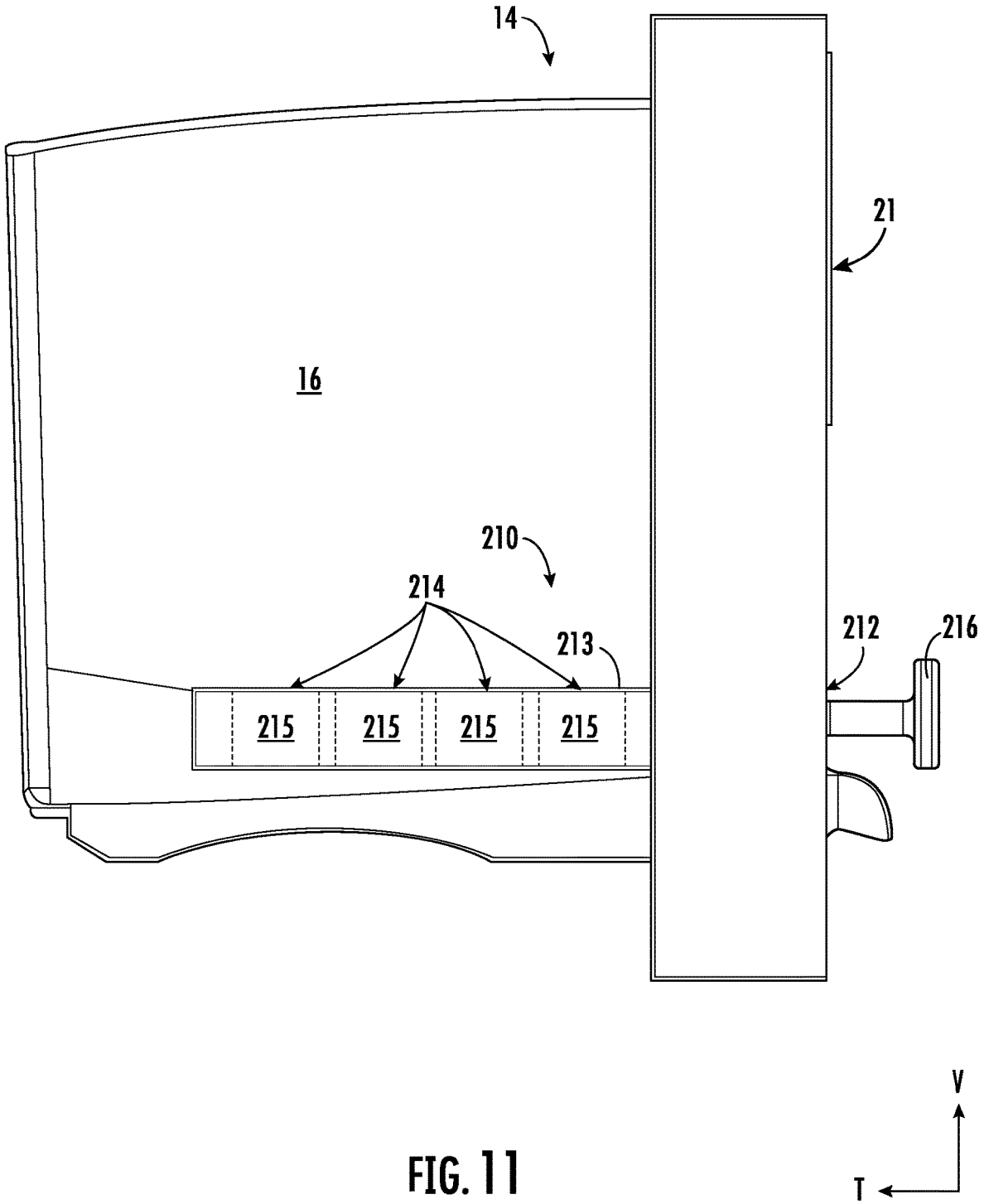
FIG. 11 is a side view of the container of FIG. 6 with another example embodiment of the dispenser assembly of FIG. 9 coupled to and positioned therein.

Illustrated in FIG. 11 is a side view of another example embodiment of the dispenser assembly of FIG. 9, including a handle 216 extending from front portion 212. In this example embodiment, tray 213 may be moved to the open position via pulling tray 213 via handle 216, exposing one or more of the plurality of compartments 214 to outside of container 14, whereby the specified amount of ice 18 within compartment(s) 214 may be dispensed.

Figure 12:
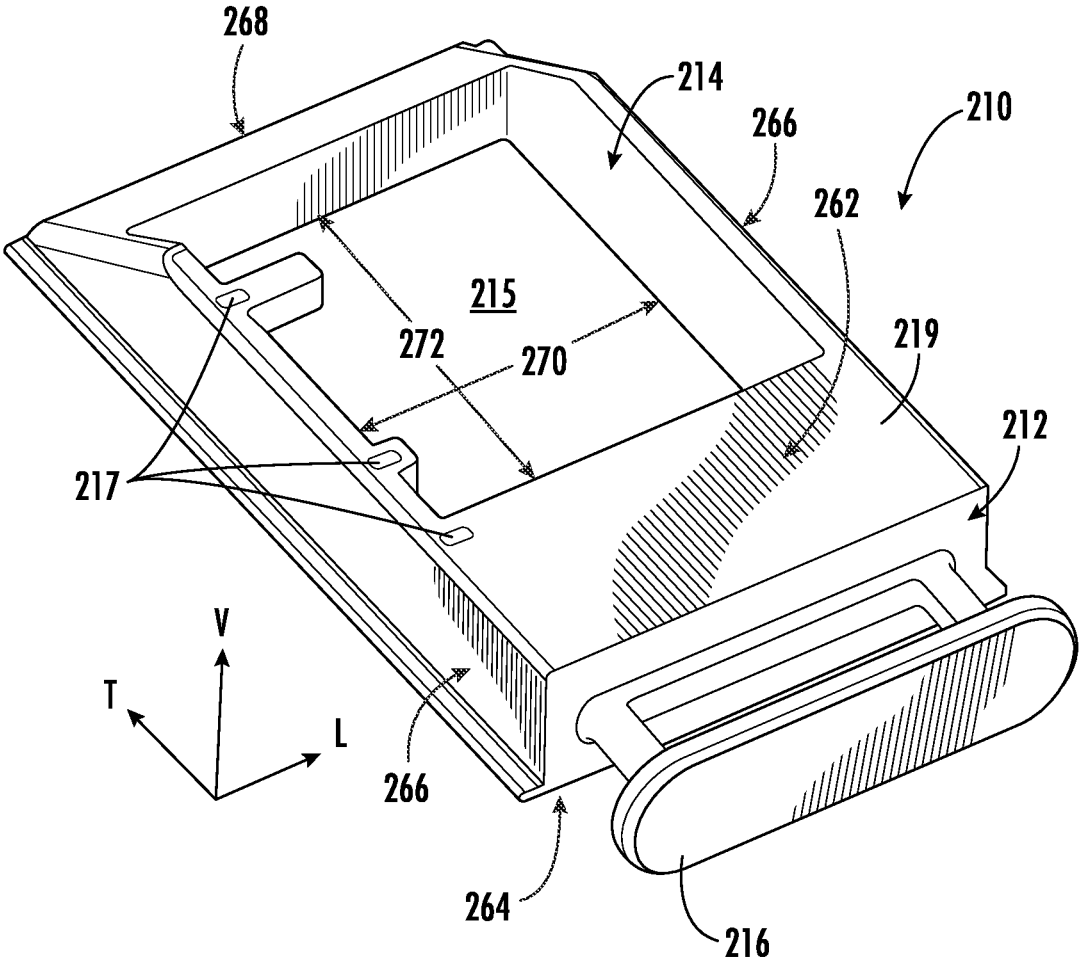
FIG. 12 is a perspective view of another example embodiment of a dispenser assembly.
Figure 13:
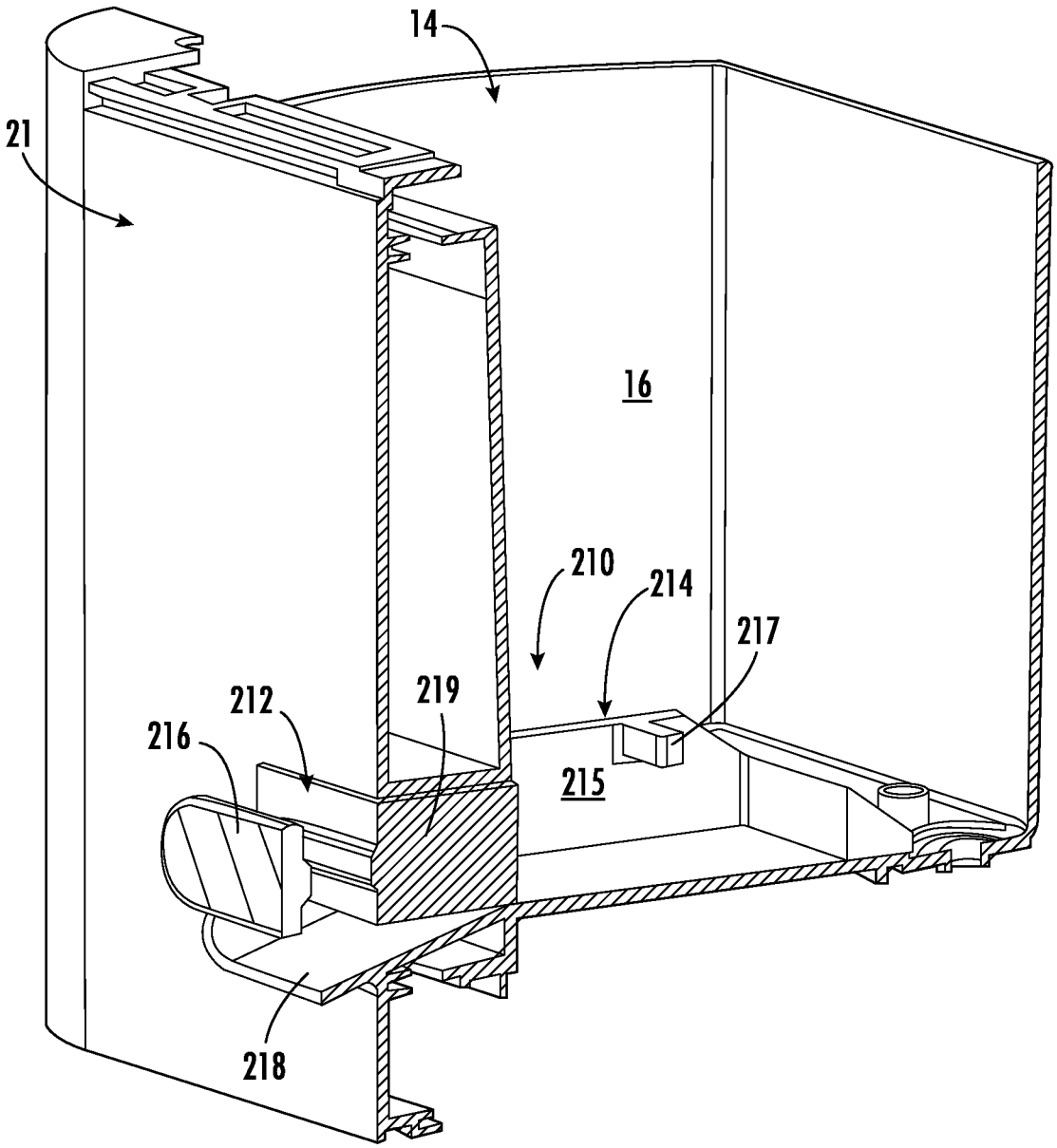
FIG. 13 is a perspective view of the example embodiment of the dispenser assembly of FIG. 12 coupled to and positioned within a container.

Illustrated in FIGS. 12-13 are perspective views of another example embodiment of the dispenser assembly of FIG. 6. In particular, FIG. 12 illustrates a perspective view of a slider 219 of dispenser assembly 210, and FIG. 13 illustrates a perspective view of slider 219 mounted to and extending within container 14. In the present example embodiment, front portion 212 of dispenser assembly 210 may be the front surface of slider 219. Slider 219 may be generally rectangularly shaped. For example, slider 219 may generally extend between a top side 262 and a bottom side 264 in the vertical direction V, between a pair of opposing outer sidewalls 266 in the lateral direction L, and between front portion 212 and back side 268 in the transverse direction T. The distance between front portion 212 and back side 260 may be no less than five centimeters (5 cm), such as between five centimeters (5 cm) and twenty centimeters (20 cm), such as between 10 centimeters (10 cm) and 15 centimeters (15 cm) in the transverse direction T. In general, slider 219 may include a singular compartment 214, such as an opening or cutout defined through slider 219, e.g., the singular compartment 214 may be an opening with a generally square or rectangular shaped cross-section (e.g., in a horizontal plane generally perpendicular to the vertical direction V) within slider 219. For example, the singular compartment 214 through slider 219 (e.g., extending entirely through the slider 219 from top to bottom generally along the vertical direction V) may be defined between a pair of opposing inner walls 270 in the lateral direction L and between a pair of opposing inner walls 272 in the transverse direction T, such that an internal volume 215 of the singular compartment 214 is defined. In particular, slider 219 may be sized (between the pair of opposing inner walls 270 in the lateral direction L and between the pair of opposing inner walls 272 in the transverse direction T) such that internal volume 215 of the singular compartment 214 allots, at least, the specified amount of ice 18.

In some embodiments, e.g., where dispenser assembly 210 includes slider 219, a predefined amount of ice 18 which may be held within the internal volume 215 of the compartment 214 may be greater than the specified amount of ice 18. For example, internal volume 215 may be sized (between the pair of opposing inner walls 270 in the lateral direction L and between the pair of opposing inner walls 272 in the transverse direction T) to allot for the predefined amount of ice 18, e.g., the predefined amount of ice may be between two (2) and ten (10), such as between four (4) and eight (8), such as between five (5) and six (6) nuggets of ice 18 held within compartment 214, however, compartment 214 of slider 219 may hold up to about twenty (20) nuggets of ice 18 in total. Slider 219 may be configured to transport the predefined amount of ice 18 from inside container 14 to outside of container 14, when slider 219 translates from inside container 14 to outside of container 14, such that the internal volume 215 of the compartment 214, and any ice pieces therein, is accessible from outside of the container 14 when slider 219 is in the open position.

In general, the front portion 212 is configured to operate the dispenser assembly 210, slider 219, by pulling on handle 216 at the front portion 212 to translate slider 219 to the open position. In particular, slider 219 may be pulled by handle 216 at front portion 212, thereby exposing compartment 214 to outside of container 14. Slider 219 may include one or more indicators 217, e.g., indents disposed in top side 262 or tabs extending into internal volume 215 from one of inner walls 270. In general, as slider 219 is pulled from container 14 indicators 217 may be positioned such that indicators 217 may provide notification of how much ice 18 is dispensed as slider 219 is pulled outward from container 14. For example, indicator 217 may indicate differing levels of ice dispensed, such as a snack amount (between two (2) and four (4) nuggets of ice 18), the specified amount (as described above), or the predefined amount (twenty (20) nuggets of ice 18, or a maximum). For example, as seen in FIG. 12, slider 219 may be pulled such that indicator 217 closest to front portion 212 is exposed outside of container 14 (such as when the slider 219 is pulled out of the container until the first indicator 217 is generally aligned with or adjacent to the front surface of the container), whereby the snack amount of ice 18 within the singular compartment 214 may be dispensed or ejected, by gravity, from the singular compartment 214 of slider 219 and down ramp 218 extending from front surface 21 of container 14.

In general, FIGS. 14-18 illustrate embodiments of dispenser assembly 210 where front portion 212 of dispenser assembly 210 includes a lever 220 extending from front surface 21 of the container. In general, the front portion 212 is configured to operate the dispenser assembly 210 by interacting with lever 220 of front portion 212 of dispenser assembly 210 in order to rotate/engage dispenser assembly 210 and dispense ice 18. The dispenser assembly 210 may include a compartment 214 generally configured to hold the specified amount of ice, wherein the compartment receives the specified amount of ice with the aid of gravity and holds the specified amount of ice within the container and/or in a space that is contiguous with an internal volume of the container.

Figure 14:
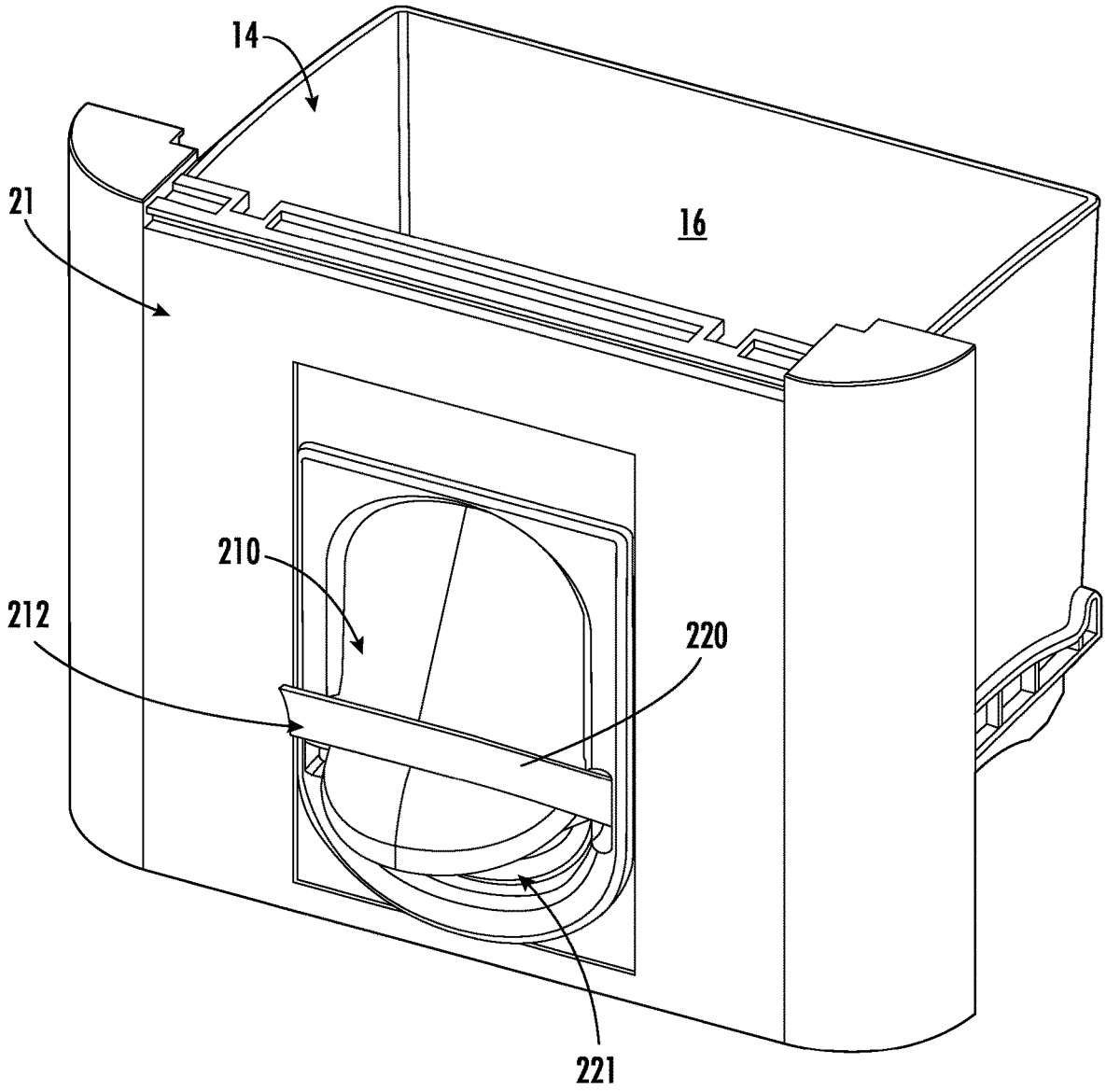
FIG. 14 is a perspective view of another example embodiment a dispenser assembly mounted to a container of the example appliance of FIG. 1.
Figure 15:
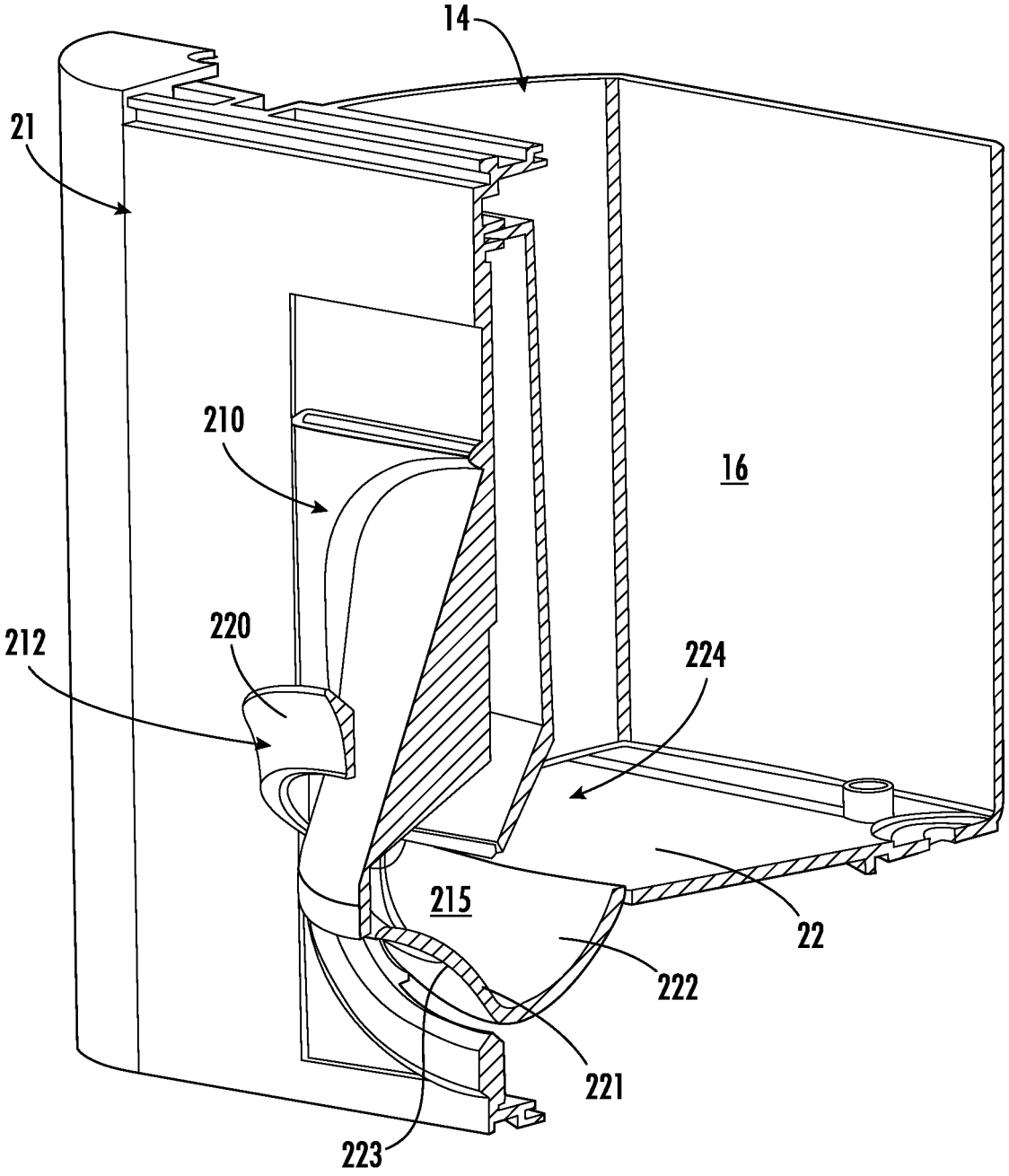
FIG. 15 is a perspective view of the example embodiment of the dispenser assembly of FIG. 14 in the closed position.
Figure 16:
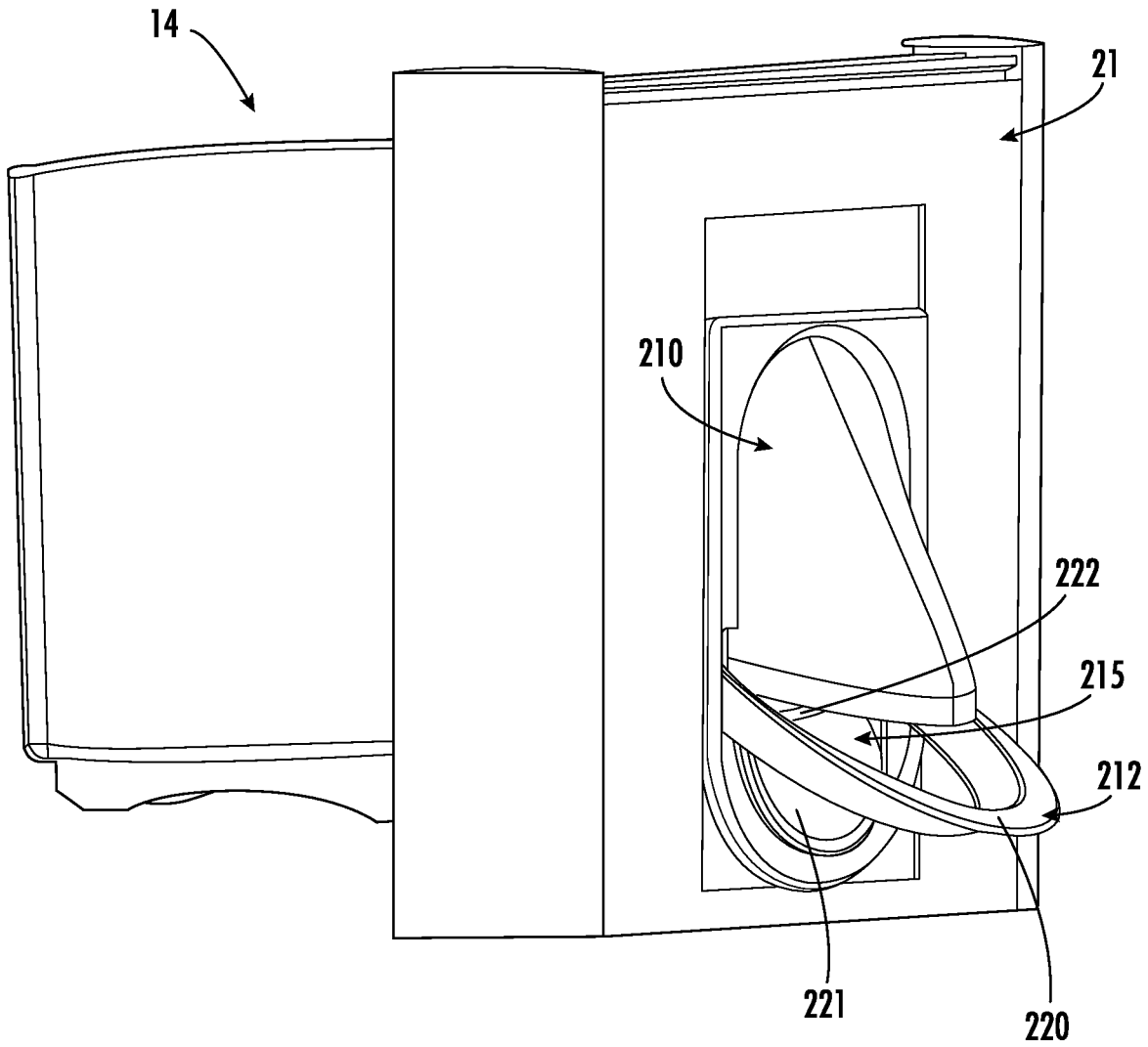
FIG. 16 is a perspective view of the example embodiment of the dispenser assembly of FIG. 14 in the open position.

FIGS. 14-16 are perspectives view of another example embodiment of dispenser assembly 210 of container 14. In particular, FIGS. 14 and 15 are perspective views of dispenser assembly 210 in the closed position, and FIG. 16 is a perspective view of dispenser assembly 210 in the open position. In the present example embodiment, front portion 212 of dispenser assembly 210 may be the front surface of lever 220. Dispenser assembly 210 may include a bucket 221 positioned proximate base wall 22 of container 14, e.g., bucket 221 may be generally positioned at an opening 224 of container 14, proximate base wall 22 of container 14. In the present example embodiment, bucket 221 may extend outward from container 14 such that the entirety of dispenser assembly 210 in FIGS. 14-16 is outside of container 14. Bucket 221 may be generally configured to parcel the specified amount of ice 18, in internal volume 215 of bucket 221. More specifically, bucket 221 of dispenser assembly 210 may be shaped such that a spout wall 223 may be convex, and a back wall 222 may be concave, thus defining internal volume 215 between spout wall 223 and back wall 222. Internal volume 215 may be shaped or sized to allot for the specified amount of ice 18, e.g., the specified amount of ice may be between two (2) and ten (10), such as between four (4) and eight (8), such as between five (5) and six (6) nuggets of ice 18 held within bucket 221.

Ice 18 may eject, via gravity, out of bucket 221 by pulling lever 220. In particular, bucket 221 may be rotated, such that an opening is created at a distal end of spout wall 223 from back wall 222, by pulling lever 220 to dispense ice 18, thereby exposing internal volume 215 of bucket 221. In other words, bucket 221 may be rotatably coupled to lever 220, which extends from front surface 21 of container 14. As seen in FIG. 15, bucket 221 may generally include back wall 222, e.g., when bucket 221 is rotated to dispense ice 18, back wall 222 may simultaneously rotate into opening 224, reducing additional amount of ice 18 from exiting container 14, or effectively dispensing only the desired specified amount of ice 18. For example, as seen in FIG. 16, lever 220 may be rotated downward to rotate bucket 221 and the specified amount of ice 18 within internal volume 215 of bucket 221 may be dispensed from front surface 21 of container 14.

In other words, a mechanical lever may be attached to a bucket of an ice storage bin. The bucket may be mounted in the dispenser close to the bottom of the ice storage bin to allow ice to fall into the bucket via gravity. In order to dispense ice from the storage bin into a user's cup (or other container which may be held below and/or in front of the dispenser assembly), the user may push the lever, wherein the bucket may rotate outwards such that the compartment of ice may be ejected down to the user's cup.

Figure 17:
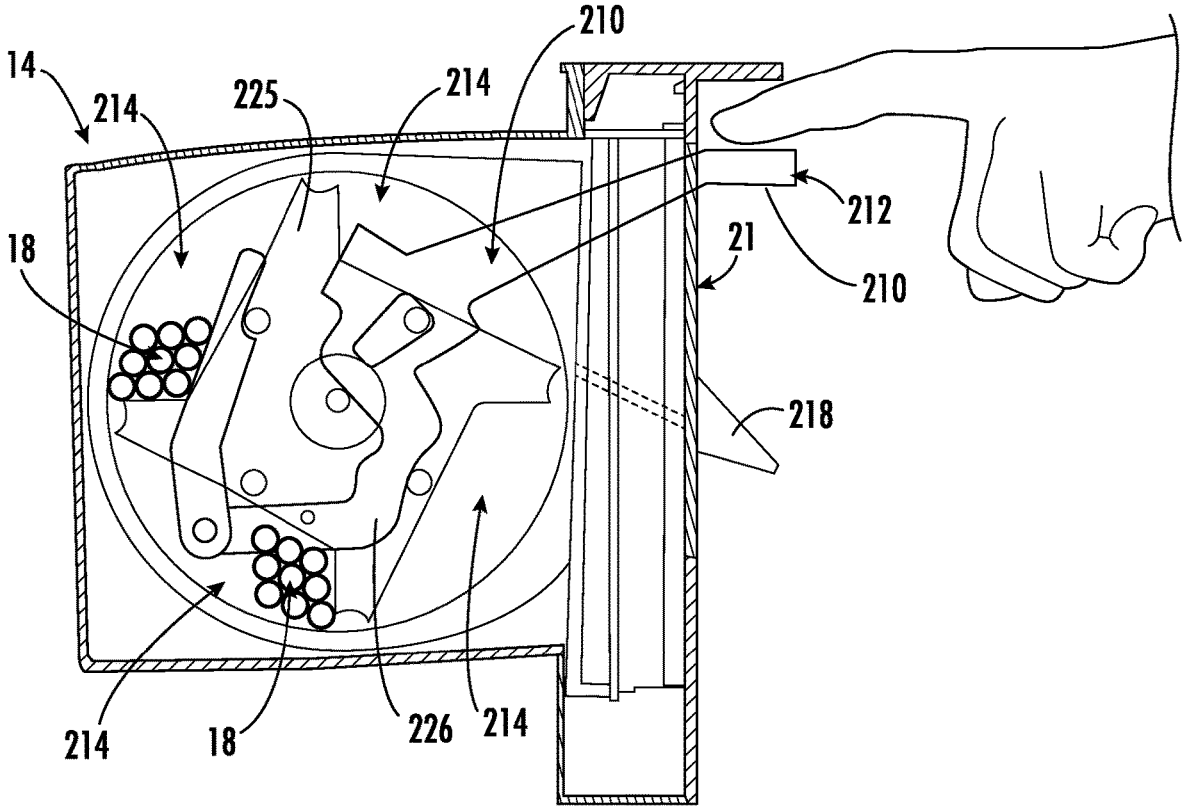
FIG. 17 is a side section view of another example embodiment a dispenser assembly of a container of the example appliance of FIG. 1, shown in the closed position.
Figure 18:
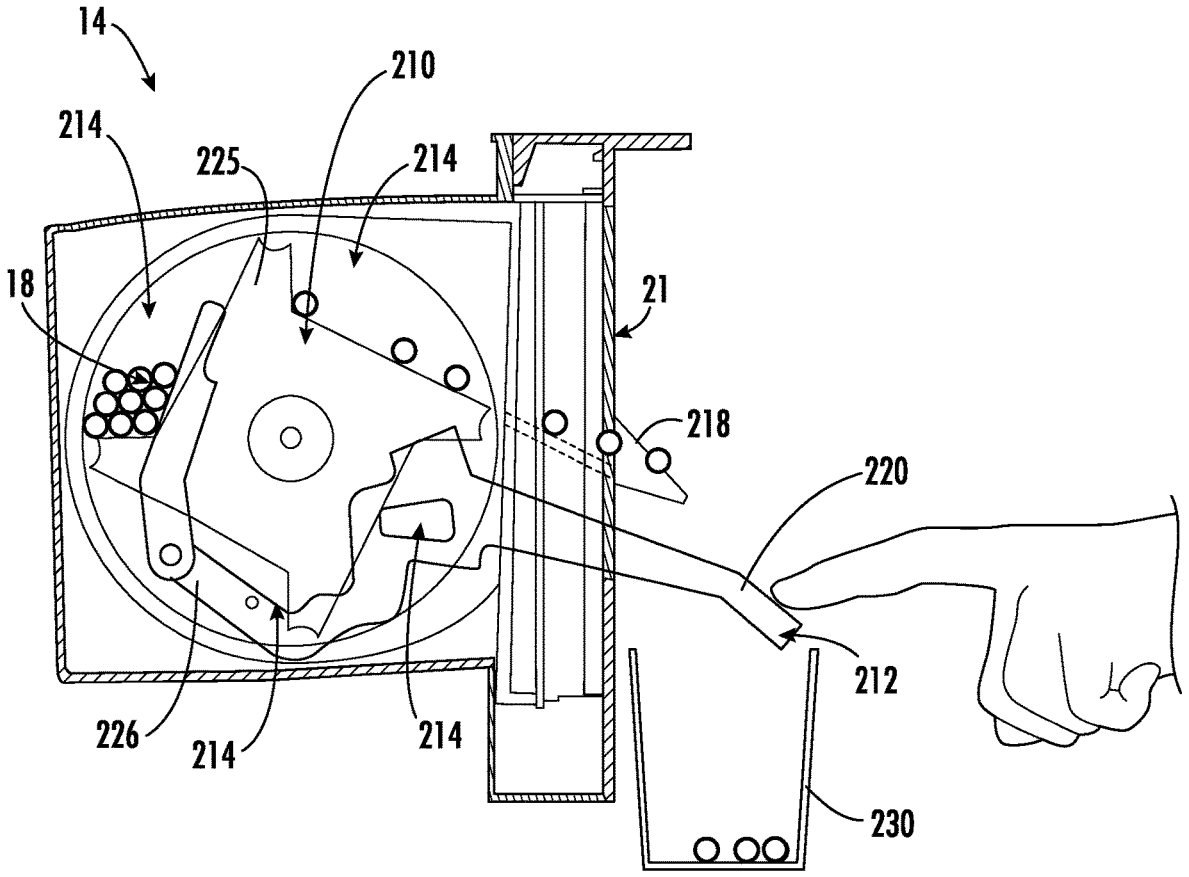
FIG. 18 a side section view of the example embodiment of the dispenser assembly of FIG. 17, shown in the open position.

FIG. 17 is a side view of another example embodiment dispenser assembly 210 of container 14 shown in the closed position, and FIG. 18 is a side view of the present example embodiment of the dispenser assembly 210 shown in the open position. In the present example embodiment, front portion 212 of dispenser assembly 210 may be the front surface of lever 220. Dispenser assembly 210 may include a rotary scoop 225 positioned within container 14, such that the entirety of dispenser assembly 210 in FIGS. 17-18 remains entirely inside of container 14 while dispensing ice. Rotary scoop 225 may be generally configured to parcel the specified amount of ice 18, in a plurality of compartments 214 positioned circumferentially around rotary scoop 225. In general, each compartment 214 defines an internal volume shaped or sized to allot for the specified amount of ice 18, e.g., the specified amount of ice may be between two (2) and ten (10), such as between four (4) and eight (8), such as between five (5) and six (6) nuggets of ice 18 held within each compartment 214 of rotary scoop 225.

In particular, rotary scoop 225 may be rotatably coupled to lever 220, extending from front surface 21 of container 14, via a ratchet arm 226. In general, a ratchet arm mechanism configured for rotating a component would be understood by those skilled in the art. In the present example embodiment, front surface 21 of container 14 may include ramp 218 extending therefrom such that rotary scoop 225 may rotatably eject ice 18 down ramp 218 and into a cup 230 when operated. One of skill in the art would understand cup 230 provided in FIG. 18 is provided for example purposes only, and cup 230 may be any other suitable type of cup, bowl, pot, or container.

In other words, a mechanical lever and ratchet system may be attached to a rotary scoop of an ice storage bin. The rotary scoop may be mounted vertically in the dispenser to prevent jamming of ice in the rotary scoop. In order to dispense ice from the storage bin into a user's cup, the user may push the lever, wherein the rotary scoop may rotate about ninety degrees (90°) such that a compartment of ice may be ejected down a ramp to the user's cup, and the rotary scoop may scoop ice into the next compartment.

Figure 19:
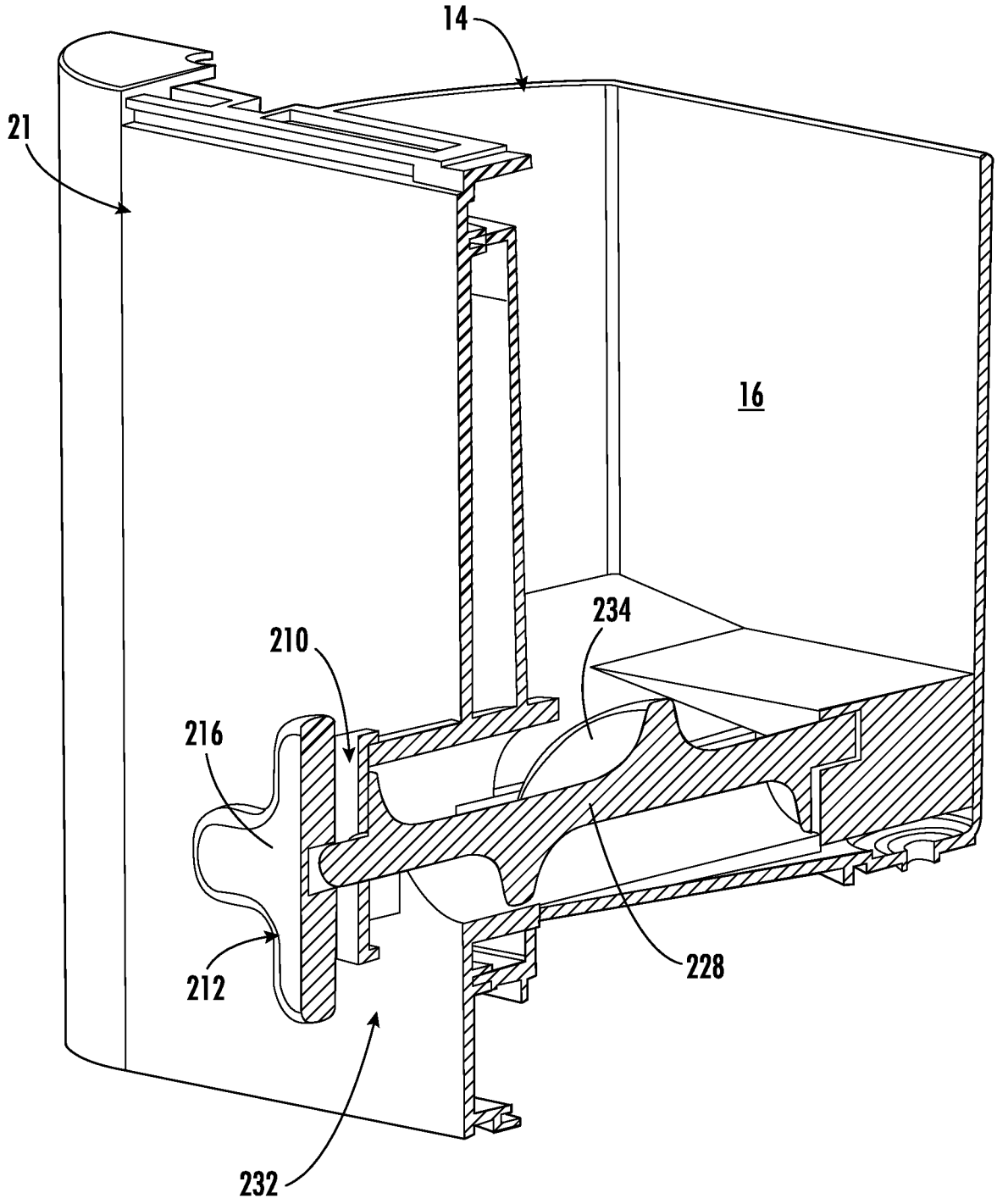
FIG. 19 is a perspective view of another example embodiment of a dispenser assembly mounted in a container of the example appliance of FIG. 1.

FIG. 19 is a perspective view of another example embodiment of dispenser assembly 210 of container 14 of the example appliance 10. In the present example embodiment, dispenser assembly 210 may include a handle 216 at front portion 212, e.g., the front portion 212 is configured to operate the dispenser assembly 210 by rotating handle 216 at the front portion 212 to dispense ice 18. In particular, handle 216 may be rotatably coupled to an auger 228, or corkscrew, configured to rotatably pull ice 18 from within container 14 and dispense ice 18 out of a chute 232 at front surface 21 of container 14. In other words, dispenser assembly 210 may include auger 228 positioned within container 14, such that auger 228 of dispenser assembly 210 in the present example embodiment remains entirely inside of container 14 while dispensing ice. In particular, a flighting 234 of auger 228 may define a volume such that a predetermined amount of rotation of handle 216 may dispense the specified amount of ice 18. For example, flighting 234 may be configured such that a quarter (¼) turn of handle 216 may expose the volume defined by flighting 234 and dispense the specified amount of ice 18.

As may be seen from the above, a fully manual ice dispenser assembly for a counter top ice making appliance generally allows a user to dispense ice from the ice maker without the need to open and reach into the ice storage area. The various embodiments of dispenser assembly 210 of appliance 10 provide various ways users may access a specified amount of ice, without putting hands, scoops, or other devices which may be contaminated into the entire ice bucket/container.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stand-alone ice making appliance, comprising:

a casing;

a user interface on the casing;

a container within the casing;

a reservoir disposed within the casing;

an ice maker disposed within the casing;

a dispenser assembly coupled to a front surface of the container, the dispenser assembly comprising a front portion configured to operate the dispenser assembly, the dispenser assembly configured to dispense a specified amount of ice, wherein, when operated, the dispenser assembly, excluding the front portion, remains either completely inside of the container or completely outside of the container, wherein the front portion of the dispenser assembly comprises a lever extending from the front surface of the container, the dispenser assembly comprising a compartment configured to hold the specified amount of ice, wherein the compartment is configured to receive the specified amount of ice by gravity, and wherein the compartment is configured to hold the specified amount of ice within an internal volume of the ice making appliance, wherein the dispenser assembly comprises a bucket rotatably coupled to the lever extending from the front surface of the container, the container defining an opening to the bucket of the dispensing assembly, the bucket defining the compartment configured to parcel the specified amount of ice for dispensing.

2. The stand-alone ice making appliance of claim 1, wherein the bucket defines a back wall configured to rotate into the opening of the container while the lever of the dispensing assembly is rotated, dispensing only the specified amount of ice.

3. The stand-alone ice making appliance of claim 2, wherein the bucket comprises a spout wall, wherein the spout wall is convex shaped.

4. The stand-alone ice making appliance of claim 3, wherein the back wall of the bucket is concave shaped, wherein an internal volume between the spout wall and the back wall defines the compartment.

5. The stand-alone ice making appliance of claim 1, wherein the bucket is positioned at a base wall of the container.

6. An ice making appliance, comprising:

a casing;

a user interface on the casing;

a container within the casing; and a dispenser assembly coupled to a front surface of the container, the dispenser assembly comprising a front portion configured to operate the dispenser assembly, the dispenser assembly configured to dispense a specified amount of ice, wherein, when operated, the dispenser assembly, excluding the front portion, remains either completely inside of the container or completely outside of the container, wherein the front portion of the dispenser assembly comprises a lever extending from the front surface of the container, the dispenser assembly comprising a compartment configured to hold the specified amount of ice, wherein the compartment is configured to receive the specified amount of ice by gravity, and wherein the compartment is configured to hold the specified amount of ice within an internal volume of the ice making appliance, wherein the dispenser assembly comprises a rotary scoop rotatably coupled to the lever extending from the front surface of the container via a ratchet arm, the rotary scoop defining a plurality of compartments, the rotary scoop configured to parcel the specified amount of ice in each respective compartment of the plurality of compartments for dispensing.

7. The ice making appliance of claim 6, further comprising a ramp extending from the front surface of the container, the rotary scoop rotatably ejects ice down the ramp when operated.

8. The ice making appliance of claim 7, wherein the plurality of compartments of the rotary scoop are positioned circumferentially around the rotary scoop.

9. The ice making appliance of claim 7, wherein the plurality of compartments of the rotary scoop comprises at least four compartments spaced circumferentially apart by about ninety degrees.

10. An ice making appliance, comprising:

a casing;

a user interface on the casing;

a container within the casing; and a dispenser assembly coupled to a front surface of the container, the dispenser assembly comprising a front portion configured to operate the dispenser assembly, the dispenser assembly configured to dispense a specified amount of ice, wherein, when operated, the dispenser assembly, excluding the front portion, remains either completely inside of the container or completely outside of the container, wherein the dispenser assembly comprises an auger rotatably coupled to a handle extending from the front surface of the container, wherein a flighting of the auger defines a volume, the volume configured to parcel the specified amount of ice for dispensing.

11. The ice making appliance of claim 10, wherein the flighting of the auger is configured to parcel the specified amount of ice relative to a specified degree of turning the handle.

12. The ice making appliance of claim 11, wherein a chute is positioned beneath the handle at the front surface of the container, the auger configured to dispense ice out of the chute.

* * * * *